US006627373B1

(12) United States Patent
Patel et al.

(10) Patent No.: US 6,627,373 B1
(45) Date of Patent: Sep. 30, 2003

(54) TONER PROCESSES

(75) Inventors: Raj D. Patel, Oakville (CA); Michael A. Hopper, Toronto (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/106,514

(22) Filed: Mar. 25, 2002

(51) Int. Cl.[7] ..... G03G 9/083
(52) U.S. Cl. ..... 430/137.14; 430/106.2
(58) Field of Search ..... 430/137.14, 106.2

(56) References Cited

U.S. PATENT DOCUMENTS

| | | | | |
|---|---|---|---|---|
| 3,998,160 | A | 12/1976 | Pearce | 101/426 |
| 4,128,202 | A | 12/1978 | Buros | 235/493 |
| 4,517,268 | A | 5/1985 | Gruber et al. | 430/39 |
| 4,758,506 | A | 7/1988 | Lok et al. | 430/903 |
| 4,859,550 | A | 8/1989 | Gruber et al. | 430/39 |
| 5,034,298 | A | 7/1991 | Berkes et al. | 430/110 |
| 5,278,020 | A | 1/1994 | Grushkin et al. | 430/137 |
| 5,290,654 | A | 3/1994 | Sacripante et al. | 430/137 |
| 5,308,734 | A | 5/1994 | Sacripante et al. | 430/137 |
| 5,344,738 | A | 9/1994 | Kmiecik-Lawrynowicz et al. | 430/137 |
| 5,370,963 | A | 12/1994 | Patel et al. | 430/137 |
| 5,482,812 | A | 1/1996 | Hopper et al. | 430/137 |
| 5,510,221 | A | 4/1996 | Matalevich et al. | 430/106.6 |
| 5,622,806 | A | 4/1997 | Veregin et al. | 430/137 |
| 5,780,190 | A | 7/1998 | Listigovers et al. | 430/39 |
| 5,914,209 | A | 6/1999 | Grushkin | 430/106.6 |
| 5,919,595 | A | 7/1999 | Mychajlowskij et al. | 430/137 |
| 5,922,501 | A | 7/1999 | Cheng et al. | 430/137 |
| 5,925,488 | A | 7/1999 | Patel et al. | 430/137 |
| 5,945,245 | A | 8/1999 | Mychajlowskij et al. | 430/137 |
| 5,977,210 | A | 11/1999 | Patel et al. | 523/161 |
| 5,994,020 | A | 11/1999 | Patel et al. | 430/137 |
| 6,103,437 | A * | 8/2000 | Kozawa et al. | 430/106.6 |
| 6,132,924 | A | 10/2000 | Patel et al. | 430/137 |
| 6,268,102 | B1 | 7/2001 | Hopper et al. | 430/137.14 |

* cited by examiner

*Primary Examiner*—John Goodrow
(74) *Attorney, Agent, or Firm*—E. O. Palazzo

(57) ABSTRACT

An emulsion aggregation process for the preparation of a magnetite toner, and where the magnetite can function as a negatively charged coagulant to facilitate aggregation of a basic cationic latex, a cationic carbon black dispersion and a cationic wax dispersion.

29 Claims, No Drawings

TONER PROCESSES

CROSS REFERENCES

Illustrated in application U.S. Ser. No. 10/106,473 on Toner Processes, filed concurrently herewith, the disclosure of which is totally incorporated herein by reference, is a toner process for the preparation of a toner comprising mixing a colorant dispersion comprising an acicular magnetite dispersion and a carbon black dispersion with a latex, a wax dispersion and a coagulant.

Illustrated in application U.S. Ser. No. 10/106,512 on Toner Processes, filed concurrently herewith, the disclosure of which is totally incorporated herein by reference, is a process comprising heating an acidified dispersion of an acicular magnetite, a carbon black colorant dispersion, an optional wax dispersion, and an acicular latex.

Illustrated in application U.S. Ser. No. 10/106,519, filed concurrently herewith, the disclosure of which is totally incorporated herein by reference, a process for the preparation of a magnetic toner comprising heating a colorant dispersion containing acicular magnetite, a carbon black dispersion, a latex emulsion, and a wax dispersion.

Illustrated in application U.S. Ser. No. 10/086,063 on Toner Processes, the disclosure of which is totally incorporated herein by reference, is a process comprising heating a latex, a colorant dispersion, a polytetrafluoroethylene dispersion, and an organo metallic complexing component.

Illustrated in application U.S. Ser. No. 10/106,520 on Toner Coagulant Processes, the disclosure of which is totally incorporated herein by reference, is a process for the preparation of toner comprising (i) generating or providing a latex emulsion containing resin, water, and an ionic surfactant, and generating or providing a colorant dispersion containing colorant, water, and an ionic surfactant, or a nonionic surfactant;

(ii) blending the latex emulsion with the colorant dispersion;

(iii) adding to the resulting blend a coagulant of a polyamine salt of an acid wherein the salt is of an opposite charge polarity to that of the surfactant latex;

(iv) heating the resulting mixture below or about equal to the glass transition temperature (Tg) of the latex resin;

(v) optionally adding a second latex comprised of resin particles suspended in an aqueous phase resulting in a shell;

(vi) adjusting with a base the pH to about 7 to about 9;

(vii) heating the resulting mixture of (vi) above about the Tg of the latex resin;

(viii) retaining the heating until the fusion or coalescence of resin and colorant is initiated;

(ix) changing the pH of the above (viii) mixture with an acid to arrive at a pH of about 1.5 to about 3.5 to thereby accelerate the fusion or the coalescence and resulting in toner particles comprised of resin, and colorant; and (x) optionally isolating the toner.

BACKGROUND

The present invention relates to toner processes, and more specifically, to aggregation and coalescence processes for the preparation of toner compositions containing magnetite. More specifically, the present invention in embodiments relates to processes for the preparation of a toner composition by a chemical process, such as emulsion aggregation, wherein the latex particles are aggregated with the colorant particles such as magnetite comprised of iron oxides, and wherein such particles can simultaneously function as colorant particles and as a coagulating or flocculating agent and thereafter coalescing or fusing to provide toner size particles which when developed by an electrographic process generates documents suitable for magnetic image character recognition or MICR. Also, in embodiments the present invention relates to the use of magnetite particles, which exhibits a negative or an anionic charge of about −2 to about −40 coulombs per square centimeter (coulombs/cm$^2$) at high pH conditions such as, for example, from about 6.5 to about 10, and which magnetite can function as a coagulating or flocculating agent for cationically charged species, or components.

REFERENCES

In U.S. Pat. No. 6,132,924, the disclosure of which is totally incorporated herein by reference, there is illustrated a process for the preparation of toner comprising mixing a colorant a latex and a coagulant, followed by aggregation and coalescence, wherein the coagulant may be a polyaluminum chloride.

In U.S. Pat. No. 6,268,102, the disclosure of which is totally incorporated herein by reference, there is illustrated a process for the preparation of toner comprising mixing a colorant a latex,and a coagulant, followed by aggregation and coalescence, wherein the coagulant may be a polyaluminum sulfosilicate.

Illustrated in U.S. Pat. No. 5,994,020, the disclosure of which is totally incorporated herein by reference, are toner preparation processes, and more specifically, a process for the preparation of toner comprising (i) preparing, or providing a colorant dispersion;

(ii) preparing; or providing a functionalized wax dispersion comprised of a functionalized wax contained in a dispersant mixture comprised of a nonionic surfactant, an ionic surfactant, or mixtures thereof;

(iii) shearing the resulting mixture of the functionalized wax dispersion (ii) and the colorant dispersion (i) with a latex or emulsion blend comprised of resin contained in a mixture of an anionic surfactant and a nonionic surfactant;

(iv) heating the resulting sheared blend of (iii) below about the glass transition temperature (Tg) of the resin particles;

(v) optionally adding additional anionic surfactant to the resulting aggregated suspension of (iv) to prevent, or minimize additional particle growth of the resulting electrostatically bound toner size aggregates during coalescence (iv);

(vi) heating the resulting mixture of (v) above about the Tg of the resin; and optionally, (vi) separating the toner particles.

With respect to the references only a small part thereof has been selected and this part may or may not be fully representative of the prior art teachings or disclosures.

Magnetic ink printing methods with inks containing magnetic particles are known. For example, there is disclosed in U.S. Pat. No. 3,998,160 that various magnetic inks have been used in printing digits, characters, or artistic designs, on checks or bank notes. The magnetic ink used for these processes contains, for example, acicular magnetic particles, such as magnetite in a fluid medium, and a magnetic coating of ferric oxide, chromium dioxide, or similar materialsdispersed in a vehicle comprising binders and plasticizers. According to the disclosure of the '160 patent there is provided a method of printing on a surface with an ink including acicular magnetic particles permitting the authenticity of the printing can be verified, and wherein a pattern is formed on a carrier with the ink in the wet state, and wherein the particles are subjected to a magnetic aligning process while the ink is on the carrier.

Disclosed in U.S. Pat. No. 4,128,202 is a device for transporting a document that has been mutilated or erroneously encoded wherein there is provided a predetermined area for the receipt of correctly encoded magnetic image character recognition information (MICR). As indicated in this patent, the information involved is referred to as MICR characters, which characters appear, for example, at the bottom of personal checks as printed numbers and symbols. These checks have been printed in an ink containing magnetizable particles therein, and when the information contained on the document is to be read, the document is passed through a sorter/reader which first magnetizes the magnetizable particles, and subsequently detects a magnetic field of the symbols resulting from the magnetic retentivity of the ink. The characters and symbols involved, according to the '202 patent, are generally segregated into three separate fields, the first field being termed a transient field, which contains the appropriate symbols and characters to identify the bank, bank branch, or the issuing source. The second field contains the account affected by the transactions, and the third field, which is not prerecorded, indicates the amount of the check.

In U.S. Pat. No. 5,914,209, the disclosure of which is totally incorporated by reference, there is illustrated a process of preparing MICR toners using a combination of hard and soft magnetites and lubricating wax in the formulation and melt mixing with a resin followed by jetting and classifying the blend to provide toner compositions.

In U.S. Pat. No. 4,517,268, the disclosure of which is totally incorporated by reference, there is illustrated a process for the preparation of MICR toners by melt mixing the appropriate components in a Banbury apparatus, following by pulverizing the magnetite and the resin, and then jetting and classifying to provide, for example, about 10 to about 12 micron toner size particles which when mixed with an additive package and carrier can provide a developer suitable for the Xerox Corporation 9700®.

Other patents relating to MICR processes include U.S. Pat. Nos. 4,859,550; 5,510,221, and 5,034,298.

In U.S. Pat. No. 5,780,190, the disclosure of which is totally incorporated herein by reference, there is disclosed an ionographic process which comprises the generation of a latent image comprised of characters; developing the image with an encapsulated magnetic-toner comprised of a core comprised of a polymer and soft magnetite and wherein the core is encapsulated within a polymeric shell; and subsequently providing the developed image with magnetic ink characters thereon to a reader/sorter device.

Illustrated in U.S. Pat. No. 4,758,506, the disclosure of which is totally incorporated herein by reference, are single-component development cold pressure fixable toner compositions, wherein the shell selected can be prepared by an interfacial polymerization process. Also known are single component magnetic cold pressure fixable toner compositions comprised of magnetite and a polyisobutylene encapsulated in a polymeric shell material generated by an interfacial polymerization process.

In situations requiring MICR capabilities the toners selected usually contain magnetites having specific properties, an important one of which is a high enough level of remanence or retentivity. Retentivity is a measure of the magnetism remaining when the magnetite is removed from the magnetic field, i.e., the residual magnetism. Also, of interest is the high retentivity such that when the characters are read, the magnetites produce a signal, or signal strength of the toner composition. The magnetic signal level is of value in MICR systems, and the signal level can vary in proportion to the amount of toner deposited on the document being generated and the signal strength of the toner composition can be measured by using known devices, including the MICR-Mate 1, manufactured by Checkmate Electronics, Inc.

In forming toner compositions for use with reprographic or xerographic print devices, emulsion aggregation processes are known. For example, emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210.

In addition, the following U.S. patents relate to emulsion aggregation processes for the formation of toner compositions, the disclosures of which are totally incorporated herein by reference.

U.S. Pat. No. 5,922,501 describes a process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

U.S. Pat. No. 5,945,245 describes a surfactant free process for the preparation of toner comprising heating a mixture of an emulsion latex, a colorant, and an organic complexing agent.

U.S. Pat. No. 5,482,812 describes a process for the preparation of toner compositions or toner particles comprising (i) providing an aqueous pigment dispersion comprised of a pigment, an ionic surfactant, and optionally a charge control agent; (ii) providing a wax dispersion comprised of wax, a dispersant comprised of nonionic surfactant, ionic surfactant or mixtures thereof; (iii) shearing a mixture of the wax dispersion and the pigment dispersion with a latex or emulsion blend comprised of resin, a counterionic surfactant with a charge polarity of opposite sign to that of said ionic surfactant and a nonionic surfactant; (iv) heating the above sheared blend below about the glass transition temperature (Tg) of the resin to form electrostatically bound toner size aggregates with a narrow particle size distribution; (v) adding additional ionic surfactant to the aggregated suspension of (iv) to ensure that no, or minimal additional particle growth of the electrostatically bound toner size aggregates occurs on further increasing the temperature to coalesce the aggregates into toner particles (vi); (vi) heating the mixture of (v) with bound aggregates above about or at the Tg of the resin; and optionally (vii) separating the toner particles from the aqueous slurry by filtration and thereafter optionally washing.

U.S. Pat. No. 5,622,806 describes a process, for example, for the preparation of toner compositions with controlled particle size comprising (i) preparing a pigment dispersion in water, which dispersion is comprised of a pigment, an ionic surfactant in amounts of from about 0.5 to about 10 percent by weight to water, and an optional charge control agent; (ii) shearing the pigment dispersion with a latex mixture comprised of a counterionic surfactant with a charge polarity of opposite sign to that of the ionic surfactant, a nonionic surfactant, and resin particles, thereby causing a flocculation or heterocoagulation of the formed particles of pigment, resin, and charge control agent; and (iii) stirring.

SUMMARY

It is a feature of the present invention to provide a magnetite containing toner for Magnetic Ink Character Recognition processes by, for example, using a specific type of magnetite to provide an acceptable readability signal by a check reader.

In another feature of the present invention, there is provided a process for the preparation of a MICR toner by an emulsion aggregation process in which the magnetite comprised of iron oxides, such as FeO and $Fe_2O_3$ pigment particles, can also function as a coagulating agent; thus the magnetite particles can exhibit negative charging characteristics in basic or high pH conditions without the need of any external coagulating agents such as anionic coagulants such as surfactants.

Another feature disclosed resides in the use of magnetite and other oxides particles, for example titanium, aluminum zirconium, which exhibit also a dual charge depending on the pH of the surrounding media, allowing the particles to be used as coagulating/flocculating agents for anionic or cationic systems. Cationic latexes with a basic pH of, for example, about 7.5 to about 10 and can readily be aggregated with a cationic wax dispersion using magnetite particles that exhibit a negative charge in basic pH conditions, thereby acting as a flocculating agent. Magnetite particles when dispersed in water in the presence of a cationic or optionally a nonionic surfactant provide a magnetite dispersion with the resulting dispersion generally neutral in pH where the pH is, for example, of about 6.5 to about 7 where the surface charge of the magnetite particle is neutral, for example about 0 to about −2 coulombs/$cm^2$. By introducing a basic cationic latex whose pH is about 9 to about 11 to the magnetite dispersion induces a negative charge on the magnetic particles thereby acting as a flocculating agents for the cationic species.

It is further another feature of the present invention to provide a MICR toner prepared by emulsion aggregation wherein the particle morphology can be tailored from, for example, a potato to spherical shape.

It is also a feature of the present invention to provide a MICR toner by emulsion aggregation process by the full incorporation therein of needle shape or acicular magnetite particles which are of a size diameter of about 450 nanometers to about 700 nanometers.

It is yet another feature of the present invention to provide a process that is capable of incorporating into toners needle shape or acicular magnetite which have a coercivity of about twice that of the cubic or spherical magnetite to thereby provide an adequate magnetic signal for readability by commercial check readers.

In another feature of the present invention there is provided a process for the preparation of a MICR toner by emulsion aggregation process wherein the amount of acicular magnetite loading is about 25 to about 35 weight percent of toner, and wherein the amount of spherical or cubic magnetite loadings is about 45 to about 65 weight percent to achieve a suitable MICR signal and the difference is due to size of the cubic or spherical magnetite and their magnetization power is very low. The magnetic signal is the measure of the standard calibration document as defined by the Banker's Association Standard and Specifications for MICR Encoded Document. Generally, each country sets a minimum percent signal level, for example the minimum signal level in the USA is 50 percent of the nominal, while in Canada it is 80 percent of the nominal. To ensure latitude in the printing process, it is generally desirable to exceed the nominal specification, for example the target signal which is about 115 to about 130 percent of the nominal to minimize the document rejection rates.

Yet another feature disclosed resides in a process for preparing a magnetite dispersion comprising acicular or cubic iron oxide particles in water containing a cationic surfactant or a nonionic surfactant by ball milling, attrition, polytroning or media milling resulting in iron oxide particle stabilized by the surfactant, and wherein the dispersion is aggregated with latex particles and wax particles to obtain a MICR toner.

In another feature of the present invention there resides a process for preparing a MICR toner in which the magnetite dispersion comprising acicular iron oxide particles in water and a cationic or a nonionic surfactant in which the iron oxide particles tend to settle due to the density differences, and which particles can be redispersed by stirring, including homogenization to obtain a suitable magnetite dispersion for the preparation of MICR toners.

EMBODIMENTS

Aspects disclosed herein relate to a process for the preparation of a magnetic toner comprising the heating of a colorant dispersion comprised of a magnetite dispersion, and a carbon black dispersion, and thereafter mixing with a basic cationic latex emulsion and a wax dispersion; a process comprising the heating of a colorant dispersion comprised of a magnetite dispersion, and a carbon black dispersion and thereafter mixing with a latex; a toner process which comprises heating a latex emulsion with a magnetite dispersion and a carbon black dispersion wherein the heating in sequence is below the latex resin glass transition temperature and above the latex resin Tg, and wherein the magnetite is an acicular magnetite; a process comprising mixing an acicular magnetite dispersion, and a carbon black dispersion with a latex emulsion and a wax dispersion; a process for the preparation of a MICR toner wherein there are selected two dispersions of (i) a magnetite dispersion and (ii) a colorant, such as carbon black dispersion; a process comprising (i) providing an acicular magnetite dispersion which contains water and a cationic surfactant, or a nonionic surfactant, and a carbon black dispersion of water and a cationic surfactant, or a nonionic surfactant, and wherein the pH of the dispersion is about 6.5 and wherein the latex selected is an emulsion comprised of an cationic surfactant, water and resin, and which emulsion is at a pH of about 10;

(ii) wherein the colorant dispersion is blended with the latex emulsion, and thereafter adding a wax dispersion comprised of submicron wax particles of from about 0.1 to about 0.5 micron in diameter by volume, and which wax is dispersed in a cationic surfactant;

(iii) resulting in a blend possessing a pH of about 8.5 to about 9.5 thereby inducing a negative charge on the magnetite particles to thereby initiate flocculation or aggregation of the resin latex, the colorant, and the wax;

(iv) heating the resulting mixture below about, or about equal to the glass transition temperature (Tg) of the latex resin to form toner sized aggregates;

(v) adding to the formed toner aggregates a second latex comprised of resin suspended in an aqueous phase containing a cationic surfactant and water, and stirring for a sufficient period of time to permit stabilization of the aggregate particle size;

(vi) adding to the resulting mixture an acid to thereby change the pH, which is initially from about 8.5 to about 9.5, to arrive at a pH of from about 6 to 6.8 for the resulting toner aggregate mixture;

(vii) heating the resulting aggregate suspension of (vi) above about the Tg of the latex resin of (i), while maintaining the pH at a value of about 6 to about 6.8;

(viii) retaining the mixture temperature at from about 85° C. to about 95° C. (degrees Centigrade) optionally for a period of about 10 to about 60 minutes, followed by a pH increase with a base to arrive at a pH of about 7 to about 8;

(ix) retaining the mixture temperature from about 85° C. to about 95° C. for a period of about 7 to about 14 hours to assist in permitting the fusion or coalescence of the toner aggregates and to obtain smooth particles;

(x) washing the resulting toner slurry; and (xi) isolating the toner; a process wherein the latex resin particles are from about 0.15 to about 0.3 micron in volume average diameter; and wherein the colorant is a magnetite pigment of a size diameter of about 0.6 micron to about 0.1 micron, and the carbon black is of a size diameter of about 0.01 to about 0.2 micron in average volume diameter; the acid is selected from the group consisting of nitric, sulfuric, hydrochloric, citric and acetic acid; the base is selected from the group consisting of sodium hydroxide, potassium hydroxide, and ammonium hydroxide; there is added to the formed toner aggregates a second latex comprised of submicron resin particles suspended in an aqueous phase containing a cationic surfactant, and wherein the second latex is selected in an amount of from about 10 to about 40 percent by weight of the initial latex, and forms a shell thereover on the formed aggregates, and which shell is of a thickness of, for example, about 0.2 to about 0.8 micron; wherein the added latex contains the same resin as the initial latex of (i), or wherein the added latex contains a dissimilar resin than that of the initial latex; the pH of the mixture resulting in (vi) is decreased from a pH of about 8.5 to about 9.5 to about 6 to about 6.8 with an acid, and wherein the acid functions primarily as a stabilizer for the aggregates during coalescence (vii), and no or minimal toner particle size or GSD increases result; the temperature at which toner sized aggregates are formed controls the size of the aggregates, and wherein the final toner size is from about 5 to about 15 microns in volume average diameter; the aggregation (iv) temperature is from about 45° C. to about 60° C., and wherein the coalescence or fusion temperature of (vii) and (viii) is from about 85° C. to about 95° C.; the time of coalescence or fusion is from about 12 to about 20 hours and wherein there are provided toner particles with a smooth morphology; a process for the preparation of a toner comprising (i) forming a resin latex dispersion of a resin in an aqueous cationic surfactant solution from a latex utilizing a cationic surfactant and optionally a nonionic surfactant where the latex pH is about 10 to about 11; (ii) preparing a pigment dispersion in water, and wherein the pigment is an acicular magnetite pigment dispersed in water and a cationic surfactant dispersion, and optionally a nonionic surfactant, wherein the pH of the dispersion is about 6.3 to about 7 followed by adding a cationic dispersion of a carbon black pigment; (iii) blending the resulting basic cationic resin latex dispersion of a pH of about 10 to about 11 with the pigment dispersion of (ii), followed by the addition of a cationic wax dispersion, resin/pigment/wax blend with a pH of about 9.3, thereby inducing a negative charge on the magnetite surface to initiate flocculation or aggregation of the resin, carbon black, wax particles, and magnetite particles; (iv) continuously subjecting the mixture to high shear to form a homogeneous gel of the blend; (v) heating the sheared gel at a temperature below the glass transition temperature (Tg) of the resin while continuously stirring to form aggregate particles; (vi) following a suitable period of time to permit stabilization of the aggregate particle size, adding a latex comprised of the same latex formulation as that of (i), or optionally a cationic latex comprising a different formulation than that of (i); (vii) modifying the pH of the slurry to a pH of 6 to about 6.8 to minimize any further growth of the aggregate particles of (vi); (vii) heating the aggregate particles at a temperature above the Tg of the latex resin, followed by increasing the pH of the aggregate particles to about 7 to about 8 and heating further for a period of about 7 to about 14 hours to form coalesced particles of a toner composition; and (viii) separating and drying the toner product; a toner process comprising (i) forming a basic cationic resin latex dispersion of a resin contained in an aqueous cationic surfactant solution from a latex utilizing a cationic surfactant and a nonionic surfactant, which dispersion pH is at about 10; (ii) preparing a pigment dispersion of an acicular magnetite pigment dispersed in water and a cationic dispersant, and optionally a nonionic dispersant; adding an additional cationic pigment dispersion of carbon black with a pH of about 6.5; (iii) blending about 80 to about 99 percent by weight of the total amount of the resin latex dispersion to be added in the process with the pigment dispersion mixture to which is added a cationic wax dispersion comprising wax particles suspended in water in the presence of a cationic surfactant to form a resin/magnetite/carbon black/wax blend, which blend possesses a pH of about 8.5 to about 9.5 thereby inducing a negative surface charge on the magnetite particles, which particles function as a coagulant to initiate flocculation or aggregation; (iv) continuously subjecting the mixture to high shear to induce a homogeneous gel of the blend; (v) heating the sheared gel at a temperature below the glass transition temperature (Tg) of the latex resin while continuously stirring to form toner size aggregate particles; (vi) following a period of time to permit stabilization of the aggregate particle size; (vii) adding the remaining portion of the total amount of resin latex dispersion; (vii) charging the pH of the slurry to a pH of 6.3 with an acid to stabilize the particles to growth; (viii) then heating the aggregate particles at temperatures above the Tg of the latex resin, followed by increasing the pH to about 7.5 in stages over a period of about 60 to about 90 minutes, and further heating the mixture for a period of about 7 to about 14 hours to form coalesced toner particles; and (ix) separating and drying the toner product; a process comprising mixing a colorant dispersion of acicular magnetite and a dispersion of carbon black (whose initial pH is about 6.5 wherein at the pH the magnetite particles have neutral or slightly negative surface charge), a latex emulsion with an initial pH of about 10 and a wax dispersion resulting in a blend of latex/magnetite/carbon black/wax particles with a pH of about 9.3 wherein the resulting change in the pH of the magnetite pigment dispersion induces a negative surface charge thereby functioning as a coagulant to initiate flocculation or aggregation of the, resin, carbon black and the wax particles on the surface of the magnetite particles; a process wherein the colorant dispersion is comprised of (i) an iron oxide, water, and a cationic surfactant, or a nonionic surfactant, and a carbon black dispersion of water and a cationic surfactant, or a nonionic surfactant with a pH of about 6.5, and wherein the latex is an emulsion comprised of an anionic surfactant, water and resin with a pH of about 10;

(ii) wherein the colorant dispersion is blended with the latex emulsion, thereafter adding a wax dispersion comprised of submicron wax particles of from about 0.1 to about 0.5 micron in diameter by volume, which wax is dispersed in a cationic surfactant;

(iii) wherein the resulting blend has a pH of about 9.3 thereby inducing a negative charge on the magnetite particles to thereby initiate flocculation or aggregation of the resin latex, the colorants, and the wax when present;

(iv) heating the resulting mixture below about, or about equal to the glass transition temperature (Tg) of the latex resin to form toner sized aggregates;

(v) adding to the formed toner aggregates a second latex comprised of resin suspended in an aqueous phase containing an ionic surfactant and water, and stirring for a period of time to permit stabilization of aggregate particle size;

(vi) adding to the resulting mixture an acid to thereby change the pH which is from about 8.5 to about 9.5 to arrive at a pH of from about 6 for the resulting toner aggregate mixture;

(vii) heating the resulting aggregate suspension of (vi) above about the Tg of the latex resin of (i), while maintaining the pH at a value of about 6;

(viii) heating at about 95° C. optionally for a period of about 10 to about 60 minutes, followed by a pH increase with a base to arrive at a pH of about 7.5;

(ix) further retaining the mixture temperature from about 85° C. to about 95° C. for a period of about 7 to about 14 hours to assist in permitting the fusion or coalescence of the toner aggregates to obtain smooth particles;

(x) washing the resulting toner slurry; and (xi) isolating the toner; a process wherein the blending and aggregation are performed in the pH range of about 8 to about 9.8, and more specifically, from about 8.5 to about 9.5, while the coalescence is initially conducted in the pH range of about 6.3 to about 6.8 followed by a increase in pH to a range of about 7 to about 8 followed by further heating for a period of about 7 to about 14 hours; a process for preparing a MICR toner composition by emulsion aggregation process and which toner contains about 25 to about 35 weight percent of acicular or needle shape magnetite, and wherein there is provided smooth particles with a particle size distribution as measured on a Coulter Counter of about 1.20 to about 1.26, and wherein the toner resulting provides a MICR signal of about 1 15 to about 130 percent and a bulk remanence of about 26 emu/g wherein the remanence can be measured on a tapped powder magnetite sample in a cell of 1 centimeter by 1 centimeter by about 4 centimeters. The sample is magnetized between two magnetic pole faces with a saturating magnetic field of 2,000 Gauss, such that the induced magnetic field is perpendicular to one of the 1 by 4 centimeter faces of the cell. The sample is removed from the saturating magnetic field, and the remanence is measured perpendicular to the above 1 centimeter wide face using a Hall-Effect device or a gaussmeter, such as the F.W. Bell, Inc. Model 615 gaussmeter; a toner process wherein there is selected magnetite contained in water at, for example, a pH of about 7 to about 10 resulting in a surface charge polarity change of from about −5 to about −50 coulombs/cm$^2$, which behavior is related to the manner in which the water and the hydroxide ($OH^-$) groups interact with the oxide surface; at room temperature, for example 25° C., the magnetite surface has a point of zero charge (Pzc) corresponding to a pH of 6.5; the magnetite charge increases negatively quite strongly with increasing pH; below the Pzc, the surface charge of the magnetite increases positively with decreasing pH; at or slightly above room temperature the magnetite is negatively charged in a basic media, which negative charge causes the magnetite particles to act as a coagulating agent for the cationic latex, the cationic carbon black dispersion and the cationic wax dispersion resulting in a heterocoagulation of these components; at, for example, about 30 weight percent loading of the acicular magnetite, there is a sufficient positive charge generated to coagulate the latex, carbon black and wax; loading of less than 30 weight percent, for example 20 percent, there can be added an external coagulant, such as a metal halide, for example polyaluminum chloride, to provide narrow particle size distribution, for example 1.20 to 1.25, and wherein the point of zero charge (PZC) also moves with time, for example at 25° C., the PZC is at a pH of 6.5, and as the temperature is increased the PZC decreases in pH where, for example, at the coalescence temperature of 93° C. the PZC is 5.3.

The colorant dispersion is, for example, comprised of acicular magnetite particles dispersed in water, a cationic surfactant and a nonionic surfactant wherever the dispersion possesses a pH of from about 6.5 to about 6.8; the carbon black particles can be dispersed in water in the presence of a cationic or a nonionic surfactant at a pH of about 6.5 to about 6.8; the acicular magnetite is, for example, from about 20 to about 35 percent by weight of toner and in the presence of a basic cationic latex functions as a negatively charged particle thereby facilitating aggregation; and wherein the acicular magnetite amount is from about 23 to about 32 percent by weight of toner and in the presence of an acidic anionic latex acts as a positively charged particle thereby facilitating aggregation; wherein the acicular utilized exhibits a coercivity from about 250 to about 700 Oe (Osteads); wherein the acicular magnetite, which can be comprised of 21 percent FeO and 79 percent $Fe_2O_3$ is selected from the group consisting of B2510, B2540, B2550, HDM-S 7111, all available from Magnox, with a coercivity of from about 250 to about 500 Oe, whose remanent magnetization (Br) is about 23 to about 39 emu/g, whose saturation magnetization (Bm) is about 70 to about 90 emu/g; MR-BL with a coercivity of 340 Oe, a remanent magnetization (Br) of about 34 emu/g, a saturation magnetization (Bm) of about 85 emu/g, available from Titan Kogyo and Columbia Chemicals; MTA-740 with a coercivity of 370 Oe, a remanent magnetization (Br) of about 30 emu/g, a saturation magnetization (Bm) of about 83 emu/g, available from Toda Kogyo; AC 5151M with a coercivity of 270 Oe, a remanent magnetization (Br) of about 20 emu/g, a saturation magnetization (Bm) of about 79 emu/g, available from Bayer; MO08029, MO04232, MO4431 with a coercivity of from about 250 to about 400 Oe, a remanent magnetization (Br) of about 23 to about 60 emu/g, a saturation magnetization (Bm) of about 70 to about 90 emu/g, all available from Elementis, Inc.; wherein the toner exhibits a magnetic signal of from about 115 to about 150 percent of the nominal signal; a minimum fix temperature (MFT) of about 170 to about 195° C.; a hot offset temperature (HOT) of about 210 to about 250° C.; a process wherein the magnetite dispersion is obtained by ball milling, attrition, polytroning or media milling resulting in a stabilized magnetite or iron oxide particles in water containing an anionic surfactant; and wherein the carbon black dispersion is present in an amount of about 4 to about 8 percent by weight of toner.

Latex contains a resin or polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); the latex contains a resin selected from the group consisting of poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); and wherein the included magnetite functions as a negatively charged coagulant.

Illustrative examples of resin particles selected for the processes illustrated herein include known polymers selected, for example, from the group consisting of poly (styrene-butadiene 3-metacryloxy-2-hydroxypropyltrimethyl ammonium chloride), poly (methylstyrene-butadiene 3-metacryloxy-2-hydroxypropyltrimethyl ammonium chloride), poly(methyl methacrylate-butadiene 3-metacryloxy-2-hydroxypropyltrimethyl ammonium chloride), poly(ethyl methacrylate-butadiene 3-metacryloxy-2-hydroxypropyltrimethyl ammonium chloride), poly(propyl methacrylate-butadiene 3-metacryloxy-2-hydroxypropyltrimethyl ammonium chloride), poly(butyl methacrylate-butadiene 3-metacryloxy-2-hydroxypropyltrimethyl ammonium chloride), poly(methyl acrylate-butadiene 3-metacryloxy-2-hydroxypropyltrimethyl ammonium chloride), poly(ethyl acrylate-butadiene 3-metacryloxy-2-hydroxypropyltrimethyl ammonium chloride), poly(propyl acrylate-butadiene 3-metacryloxy-2-hydroxypropyltrimethyl ammonium chloride), poly(butyl acrylate-butadiene 3-metacryloxy-2-hydroxypropyltrimethyl ammonium chloride), poly(styrene-isoprene 3-metacryloxy-2-hydroxypropyltrimethyl ammonium chloride), poly(methylstyrene-isoprene 3-metacryloxy-2-hydroxypropyltrimethyl ammonium chloride), poly(methyl methacrylate-isoprene 3-metacryloxy-2-hydroxypropyltrimethyl ammonium chloride), poly(ethyl methacrylate-isoprene 3-metacryloxy-2-hydroxypropyltrimethyl ammonium chloride), poly (propyl methacrylate-isoprene 3-metacryloxy-2-hydroxypropyltrimethyl ammonium chloride), poly(butyl methacrylate-isoprene 3-metacryloxy-2-hydroxypropyltrimethyl ammonium chloride), poly(methyl acrylate-isoprene 3-metacryloxy-2-hydroxypropyltrimethyl ammonium chloride), poly(ethyl acrylate-isoprene 3-metacryloxy-2-hydroxypropyltrimethyl ammonium chloride), poly(propyl acrylate-isoprene 3-metacryloxy-2-hydroxypropyltrimethyl ammonium chloride), poly(butyl acrylate-isoprene 3-metacryloxy-2-hydroxypropyltrimethyl ammonium chloride); poly(styrene-propyl acrylate 3-metacryloxy-2-hydroxypropyltrimethyl ammonium chloride), poly(styrene-butyl acrylate 3-metacryloxy-2-hydroxypropyltrimethyl ammonium chloride), poly(styrene-butadiene 3-metacryloxy-2-hydroxypropyltrimethyl ammonium chloride), poly(styrene-butadiene 3-metacryloxy-2-hydroxypropyltrimethyl ammonium chloride), poly(styrene-butadiene-acrylonitrile 3-metacryloxy-2-hydroxypropyltrimethyl ammonium chloride), poly(styrene-butyl acrylate 3-metacryloxy-2-hydroxypropyltrimethyl ammonium chloride), poly(styrene-butyl acrylate 3-metacryloxy-2-hydroxypropyltrimethyl ammonium chloride), and poly(styrene-butyl acrylate-acrylononitrile 3-metacryloxy-2-hydroxypropyltrimethyl ammonium chloride).

The resin particles selected, which generally can be in embodiments styrene acrylates, styrene butadienes, styrene methacrylates, or polyesters are present in various effective amounts, such as from about 70 weight percent to about 98 weight and, more specifically, from about 80 to about 92 percent of the toner, and which particles can be of small average particle size, such as from about 0.01 micron to about 1 micron in average volume diameter as measured by the Brookhaven nanosize particle analyzer. Other effective amounts of resin can be selected.

The resin particles selected for the process of the present invention can be prepared by, for example, emulsion polymerization techniques, including semicontinuous emulsion polymerization methods, and the monomers utilized in such processes can be selected from, for example, styrene, acrylates, methacrylates, butadiene, isoprene, and optionally acid or basic olefinic monomers such as acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups in the monomer, or polymer resin is optional, and such groups can be present in various amounts of from about 0.1 to about 10 percent by weight of the polymer resin. Chain transfer agents, such as dodecanethiol or carbon tetrabromide, can also be selected when preparing resin particles by emulsion polymerization. Other processes of obtaining resin particles of from about 0.01 micron to about 1 micron can be selected from polymer microsuspension process, such as illustrated in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

Examples of cationic surfactants utilized in the colorant dispersion for the MICR toners and processes illustrated herein include, for example, dialkyl benzenealkyl ammonium chloride, lauryl trimethyl ammonium chloride, alkyl benzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof. This surfactant is utilized in various effective amounts, such as for example, from about 0.01 to about 10 percent by weight of latex resin, and more specifically, in the range of 0.1 to about 5 percent by weight of toner.

Examples of nonionic surfactants that may be included in the resin latex dispersion include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhodia as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890® and ANTAROX 897®. A suitable concentration of the nonionic surfactant is, for example, from about 0.01 to about 10 percent by weight, and more specifically, from about 0.1 to about 5 percent by weight of monomers used to prepare the toner polymer resin.

Examples that are suitable for dispersing the magnetite pigment particles can be functional copolymers including, for example, methyl vinyl ether-maleic acid, methyl vinyl ether-maleic acid calcium sodium salt, hydrophobically modified polyethers, polyvinylpyrrolidone homopolymers, alkylated vinylpyrrolidone copolymers, vinyl acetate/vinylpyrrolidone copolymers, vinylpyrrolidone/styrene block, poly(methyl vinyl ether/maleic anhydride) (linear interpolymer with 1:1 molar ratio), dimethylaminoethyl methacrylate, ethylene-vinyl acetate copolymer of maleic anhydride and acrylic acid, polystyrene-maleic anhydride, styrene-acrylic ester, ethyl acrylate/methyl methacrylate, carboxylated poly-n-butyl acrylates, or ethylene vinyl alcohol, and which dispersants can in embodiments permit the magnetite to be readily dispersible into submicron particles of about 30 to about 400 nanometers in diameter in either acid or a base, and thus resulting in a magnetite that is stabilized by resin particles.

In some instances, colorants are available in the wet cake or concentrated form containing water, and can be easily dispersed utilizing a homogenizer or simply by stirring or ball milling or attrition, or media milling. In other instances, pigments are available only in a dry form, whereby dispersion in water is effected by microfluidizing using, for example, a M-110 microfluidizer or an ultimizer and passing the pigment dispersion from 1 to 10 times through the chamber, or by sonication, such as using a Branson 700 sonicator, a homogenizer, ball milling, attrition, or media milling with the addition of dispersing agents such as cationic or nonionic surfactants.

In embodiments, the multi-stage addition of latex is conducted wherein only a portion of the total amount of latex to be added into the composition is initially present. In these embodiments, a majority, for example about 60 to about 80 percent, of the latex is added at the onset while the remainder of the latex, for example about 40 to about 20 percent, (the delayed latex) is added after the formation of the resin-pigment aggregates. This delayed addition of latex can improve the formation of an outer shell of non-pigmented material around the pigmented core, thereby encapsulating the pigment in the core removed from the toner particles surface, where the presence of magnetite pigment can modify the charging behavior of the final toner particle. Homogenization is of value to ensure the formation of particles with a narrow geometric size distribution (GSD).

The toner particles may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, and the like. Surface additives that can be added to the toner compositions after washing or drying include, for example, metal salts, metal salts of fatty acids, colloidal silicas, metal oxides, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from about 0.1 to about 2 percent which can be added during the aggregation process or blended into the formed toner product.

Developer compositions can be prepared by mixing the toners obtained with the process of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

With the process illustrated herein in embodiments, toner particles of acceptable size and narrow dispersity are obtained in a more rapid manner than disclosed in a number of prior art patents. The toner particles can possess an average volume diameter of from about 0.5 to about 30, and more specifically, from 1 to about 10 microns, and a narrow GSD characteristic of from about 1.05 to about 1.25, and more specifically, of from about 1.15 to about 1.25 as measured by a Coulter Counter. The toner product in embodiments can also possess an excellent shape factor, for example, of about 120 or less wherein the shape factor refers to the measure of toner smoothness and toner roundness, where a shape factor of 100 is considered perfectly spherical and smooth, while a shape factor of 145 is considered to be rough in surface morphology and the shape is like a potato.

The following Examples illustrate the embodiments and advantages of the present invention. Parts and percentages are by weight unless otherwise indicated.

EXAMPLES

Latex Formation Procedure Latex (A)

A latex emulsion (i) comprised of polymer particles generated from the emulsion polymerization of styrene, butyl acrylate and 3-metacryloxy-2-hydroxypropyltrimethyl ammonium chloride was prepared as follows. A surfactant solution of 16 grams of ANTAROX® (nonionic emulsifier), 18 grams of alkyl-benzyl ammonium chloride, SANIZOL B® (cationic surfactant) and 1,600 grams of deionized water was prepared by mixing for 10 minutes in a stainless steel reactor. The reactor was then purged with nitrogen. An organic phase comprising 656 grams of styrene, 144 grams of butylacrylate, 32 grams of 3-methacryloxy-2-hydropropyltrimethyl ammonium chloride, and 24 grams of dodecanethiol was separately prepared and thoroughly mixed. This organic phase was then introduced into the above aqueous phase and mixed at 150 rpm. The resulting mixture was then heated to 70° C. for a period of 6 hours. The molecular properties resulting for the resin latex throughout were $M_w$ of 60,000, $M_n$ of 10,800, as measured by a Gel Permeation Chromatograph, and a midpoint Tg of 55.8° C., as measured by a Differential Scanning Calorimeter, where the midpoint Tg refers to the halfway point between the onset and the offset Tg of the polymer. The latex prepared had a resin composition of styrene, butyl acrylate, and 3-metacryloxy-2-hydroxypropyltrimethyl ammonium chloride where the latex had a 34 percent solids content.

Latex Preparation—Latex (B)

A latex emulsion (ii) comprised of polymer particles generated from the emulsion polymerization of styrene, butyl acrylate and 3-metacryloxy-2-hydroxypropyltrimethyl ammonium chloride was prepared as follows. A surfactant solution of 16 grams of ANTAROX® (nonionic emulsifier), 18 grams of alkyl-benzyl ammonium chloride, SANIZOL B® (cationic surfactant) and 1,600 grams of deionized water was prepared by mixing for 10 minutes in a stainless steel reactor. The reactor was then purged with nitrogen. An organic phase comprising 656 grams of styrene, 144 grams of butylacrylate, 32 grams of 3-methacryloxy-2-hydropropyltrimethyl ammonium chloride, and 32 grams of dodecanethiol was separately prepared and thoroughly mixed. This organic phase was then introduced into the above aqueous phase and mixed at 150 rpm. The resulting mixture was then heated to 70° C. for a period of 6 hours. The molecular properties resulting for the resin latex throughout were $M_w$ of 40,000, $M_n$ of 10,300, as measured by a Gel Permeation Chromatograph, and a midpoint Tg of 54.8° C., as measured by a Differential Scanning Calorimeter, where the midpoint Tg is the halfway point between the onset and the offset Tg of the polymer. The latex prepared had a resin composition of styrene, butyl acrylate, and 3-metacryloxy-2-hydroxypropyltrimethyl ammonium chloride where the latex had a 34 percent solids content.

Wax and Pigment Dispersions

The aqueous wax dispersion utilized in these Examples was generated using P725 polyethylene wax of a weight average molecular weight of 725 and a melting point of 104° C. or a P850 wax with a molecular weight $M_w$ of 850 and a melting point of 107° C. and alkyl-benzyl ammonium chloride—SANIZOL B® as a cationic surfactant/dispersant. The waxes are available from Baker-Petrolite The wax particle size diameter was determined to be approximately 200 nanometers and the wax slurry was supplied with a solid loading of about 28 to about 30 percent.

The pigment dispersion utilized was an aqueous dispersion of carbon black (REGAL 330®) pigment. This pigment dispersion contained the cationic surfactant SANIZOL B®, an alkyl benzyl ammonium chloride, and the pigment content of the dispersion supplied was 18 percent carbon black, 2 percent surfactant and 80 percent water.

Example I

MICR Toner (Cationic Latex)

90 Grams of acicular black magnetite MAGNOX B 2550™ acicular, a needle shape magnetite composed of 21 percent FeO and 79 percent $Fe_2O_3$, having a particle size of 0.6 micron length×0.1 micron diameter were dispersed in 300 grams of water, to which was added 1.3 grams of cationic surfactant (SANIZOL B®) and ball milled for a period of 2 hours. The magnetite dispersion was transferred into a reaction kettle to which 90 grams of an aqueous cationic carbon black dispersion comprising 18 percent carbon black pigment, 2 percent cationic surfactant in water were added. The resulting pigment dispersion was then aggregated with 427 grams of a cationic latex (latex A) comprising submicron latex particles (30 percent solids) of styrene/butylacrylate and 3-metacryloxy-2-hydroxypropyltrimethyl ammonium chloride, and 90 grams of a cationic dispersion comprising 30 percent of submicron polyethylene P725 wax particles, to which 300 grams of water were added to reduce the viscosity, while being homogenized at a speed of 5,000 rpm. The resulting blend having a pH of 9.3 was then heated to a temperature of 52° C. for a period of 200 minutes to obtain toner size aggregates of 6.5 microns with a GSD of 1.22. 133 Grams of the above latex were then added to the aggregate mixture and left stirring overnight, about 18 to about 20 hours, at a temperature of 45° C., followed by changing the pH of the mixture from 9.3 to a pH of 6.5 with an aqueous solution of 1.25 percent aqueous nitric acid. The mixture was then heated to 93° C. during which the pH was maintained between 6.3 and 6.6 with the addition of an aqueous 1.25 percent nitric acid solution. After 3 hours at 93° C., the pH was increased in stages (e.g. 6.5 to 7.2 to 7.6) with an aqueous 4 percent of aqueous sodium hydroxide solution over a period of 1 hour. After a period of 5 hours at 93° C., the particle size measured was 6.8 microns with a GSD of 1.23. The mixture was allowed to coalesce further for a period of 12 hours resulting in a particle size of 6.9 microns with a GSD of 1.25. The resultant mixture was cooled and the toner obtained was washed 4 times with water and dried on a freeze dryer. The resulting toner was comprised of 30 percent magnetite, 57.1 percent resin, 4.4 percent carbon black, and 8.5 percent wax, and provided a magnetite signal of 115 percent of the nominal, a remanence of 25.2 emu/g and wherein the toner particles were smooth as determined by an optical microscope and with no or minimal protrusions.

Example II

90 Grams of the acicular black magnetite MAGNOX B 2550™ an acicular needle shape magnetite composed of 21 percent FeO and 79 percent $Fe_2O_3$, having a particle size of 0.6 micron length×0.1 micron diameter, were dispersed in 300 grams of water, to which were added 1.3 grams of cationic surfactant (SANIZOL B™) and ball milled for a period of 2 hours. The magnetite dispersion was transferred into a reaction kettle to which 90 grams of aqueous cationic carbon black dispersion comprised of 18 percent carbon black pigment, 2 percent cationic surfactant in water were added. The resulting pigment dispersion was then aggregated with 427 grams of a cationic latex (latex B) comprising submicron latex particles (30 percent solids) of styrene/butylacrylate and 3-metacryloxy-2-hydroxypropyl trimethyl ammonium chloride, and 90 grams of a cationic dispersion comprising 30 percent submicron polyethylene P725 wax particles, to which 300 grams of water was added to reduce the viscosity while being homogenized at speed of 5,000 rpm. The resulting blend having a pH of 9.4 was then heated to a temperature of 52° C. for a period of 240 minutes to obtain toner size aggregates of 6.6 microns with a GSD of 1.21. 133 Grams of the above latex were then added to the aggregate mixture and left stirring overnight at a temperature of 45° C., followed by changing the pH of the mixture from 9.3 to a pH of 6.5 with an aqueous solution of a 1.25 percent aqueous nitric acid. The mixture was then heated to 93° C. during which the pH was maintained between 6.3 and 6.6 with the addition of an aqueous 1.25 percent nitric acid solution. After 3 hours at 93° C., the pH was increased in stages (e.g. 6.5 to 7.2 to 7.6) with an aqueous 4 percent sodium hydroxide solution over a period of 1 hour. After a period of 5 hours at 93° C., the particle size measured was 6.9 microns with a GSD of 1.22. The mixture was allowed to coalesce further for a period of 10 hours resulting in a particle size of 6.9 microns with a GSD of 1.23. The resultant mixture was cooled and the toner obtained was washed 4 times with water and dried. The resulting toner was comprised of 30 percent magnetite, 57.1 percent resin, 4.4 percent carbon black, and 8.5 percent wax, and which toner provided a magnetite signal of 11.8 percent of the nominal, a remanence of 25.5 emu/g, and wherein the toner particles-were smooth with no or minimal protrusions.

Example III

P850 Wax:

90 Grams of the acicular black magnetite MAGNOX B2550™ acicular or needle shape magnetite composed of 21 percent FeO and 79 percent $Fe_2O_3$ having a particle size of 0.6 micron length×0.1 micron diameter were dispersed in 300 grams of water, to which 1.3 grams of cationic surfactant (SANIZOL B™) were added followed by ball milling for a period of 2 hours. The magnetite dispersion was transferred into a reaction kettle to which 90 grams of an aqueous cationic carbon black dispersion comprising 18 percent carbon black pigment, and 2 percent cationic surfactant in water were added. The resulting pigment dispersion was then aggregated with 427 grams of a cationic latex (latex B) comprising submicron, about 0.5, latex particles (30 percent solids) of styrene/butylacrylate and 3-metacryloxy-2-hydroxypropyltrimethyl ammonium chloride, and 90 grams of a cationic dispersion comprising 30 percent of submicron polyethylene P725 wax particles, to which 300 grams of water were added to reduce the viscosity, while being homogenized at a speed of 5,000 rpm. The resulting blend with a pH of 9.4 was then heated to a temperature of 52° C. for a period of 240 minutes to obtain toner size aggregates of 6.6 microns with a GSD of 1.21. 133 Grams of the above latex were then added to the aggregate mixture and stirred overnight, about 18 to about 21 hours, at a temperature of 45° C., followed by changing the pH of the mixture from 9.3 to a pH of 6.5 with an aqueous solution of 1.25 percent nitric acid. The mixture was then heated to 93° C. during which the pH was maintained between 6.3 and 6.6 with the addition of aqueous 1.25 percent nitric acid solution. After 3 hours at 93° C. the pH was increased in stages (e.g. 6.5 to 7.2 to 7.6) with an aqueous 4 percent sodium hydroxide solution over a period of 1 hour. After a period of 5 hours at 93° C., the particle size measured was 6.9 microns with a GSD of 1.22. The mixture was allowed to coalesce further for a period of 10 hours resulting in a particle size of 7.1 microns with a GSD of 1.24. The resultant mixture was cooled and the toner obtained was washed 4 times with water and dried. The resulting toner was comprised of 30 percent magnetite, 57.1 percent resin, 4.4 percent carbon black, and 8.5 percent wax, and which toner provided a magnetite signal of 117 percent of the nominal, and a remanence of 26 emu/g, and wherein the toner particles were smooth with no or minimal protrusions.

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A process for the preparation of a magnetic toner comprising the heating of a colorant dispersion comprised of a magnetite dispersion, and a carbon black dispersion, and thereafter mixing with a basic cationic latex emulsion and a wax dispersion, and wherein (i) said magnetite in said dispersion is an acicular magnetite dispersed in water and a cationic surfactant, or a nonionic surfactant, and said dispersion of carbon black contains water and a cationic surfactant, or a nonionic surfactant, and wherein said dispersion of magnetite and carbon black possesses a pH of about 6.3 to about 6.8, and wherein said latex is an emulsion comprised of a cationic surfactant, water and resin, and which emulsion is at a pH of about 10 to about 11;

(ii) wherein said colorant dispersion is blended with said latex emulsion, and thereafter adding said wax dispersion, and which dispersion is comprised of submicron wax particles of from about 0.1 to about 0.5 micron in diameter by volume and which wax is dispersed in a cationic surfactant;

(iii) wherein the resulting blend possesses a pH of about 8.5 to about 9.5 thereby inducing a negative charge on the magnetite particles to thereby initiate flocculation or aggregation of said resin latex, said colorant, and said wax;

(iv) heating the resulting mixture below about the glass transition temperature (Tg) of the latex resin to form toner sized aggregates;

(v) optionally adding to the formed toner aggregates a second latex comprised of resin suspended in an aqueous phase containing a cationic surfactant and water, and optionally stirring for a period of time to permit stabilization of aggregate particle size;

(vi) adding to the resulting mixture an acid to thereby change the pH, which is initially from about 8.5 to about 9.5, to arrive at a pH of from about 6 to about 6.9 for the resulting toner aggregate mixture;

(vii) heating the resulting aggregate suspension of (vi) above about the Tg of the latex resin of (i), while maintaining the pH at a value of about 6 to about 6.8;

(viii) retaining the mixture temperature at from about 85° C. to about 95° C. for an optional period of about 10 to about 60 minutes, followed by a pH increase with a base to arrive at a pH of about 7 to about 8;

(ix) retaining the mixture temperature at from about 85° C. to about 95° C. for an optional period of about 7 to about 14 hours to assist in permitting the fusion or coalescence of the toner aggregates and to obtain smooth particles;

(x) washing the resulting toner slurry; and (xi) isolating the toner.

2. A process in accordance with claim 1 wherein one of said colorant dispersions comprises acicular magnetite particles dispersed in water, a cationic surfactant and a nonionic surfactant, and wherein said dispersion possesses a pH of from about 6.5 to about 6.8.

3. A process in accordance with claim 1 wherein said carbon black dispersion comprises carbon black particles dispersed in water and a cationic surfactant resulting, and which dispersion possesses a pH of about 6.3 to about 6.8.

4. A process in accordance with claim 1 wherein said magnetite in an acicular magnetite is present in an amount of from about 20 to about 35 percent by weight of toner, and wherein in the presence of a basic cationic latex, said magnetite is negatively charged thereby facilitating aggregation.

5. A process in accordance with claim 1 wherein said magnetite is an acicular magnetite present in an amount of from about 23 to about 32 percent by weight of toner.

6. A process in accordance with claim 1 wherein said magnetite is an acicular with a coercivity of from about 250 to about 700 Oe.

7. A process in accordance with claim 1 wherein said acicular magnetite with a particle size of about 0.6 micron in length by 0.1 micron in diameter, and is comprised of about 21 percent FeO and about 79 percent $Fe_2O_3$.

8. A process in accordance with claim 1 wherein said toner exhibits a magnetic signal of from about 115 to about 150 percent of the nominal signal.

9. A process in accordance with claim 1 wherein said toner possesses a minimum fix temperature (MFT) of about 170° C. to about 195° C.

10. A process in accordance with claim 9 wherein the toner hot offset temperature (HOT) is from about 210° C. to about 250° C.

11. A process in accordance with claim 1 wherein the magnetite dispersion is obtained by a ball milling, attrition, polytroning or media milling resulting in magnetite particles dispersed in water containing a cationic surfactant.

12. A process in accordance with claim 1 wherein the carbon black dispersion is present in an amount of about 4 to about 8 percent by weight of toner.

13. A process in accordance with claim 1 wherein the latex resin particles are from about 0.15 to about 0.3 micron in volume average diameter.

14. A process in accordance with claim 1 wherein said magnetite is of a size of about 0.6 micron to about 0.1 micron, and said carbon black is of a size of about 0.01 to about 0.2 micron, each in average volume diameter.

15. A process in accordance with claim 1 wherein the said acid is selected from the group consisting of nitric, sulfuric, hydrochloric, citric and acetic acid.

16. A process in accordance with claim 1 wherein said base is selected from the group consisting of sodium hydroxide, potassium hydroxide, and ammonium hydroxide.

17. A process in accordance with claim 1 wherein there is added to the formed toner aggregates a second latex comprised of submicron resin particles suspended in an aqueous phase containing a cationic surfactant, and wherein said second latex is selected in an amount of from about 10 to about 40 percent by weight of the initial latex to form a shell thereover on said formed aggregates, and which shell is of a thickness of about 0.2 to about 0.8 micron.

18. A process in accordance with claim 17 wherein the added latex contains the same resin as the initial latex of (i), or wherein said added latex contains a dissimilar resin than that of the initial latex.

19. A process in accordance with claim 1 (v) wherein the pH of the mixture resulting in (vi) is decreased from about 8.5 to about 9.5 to about 6 to about 6.8 wherein said acid functions primarily as a of stabilizer for the aggregates during coalescence (vii), and no or minimal toner particle size increase results.

20. A process in accordance with claim 1 wherein the temperature at which toner sized aggregates are formed controls the size of the aggregates, and wherein the final toner size is from about 5 to about 9 microns in volume average diameter.

21. A process in accordance with claim 1 wherein the aggregation (iv) temperature is from about 45° C. to about 60° C., and wherein the coalescence or fusion temperature of (vii) and (viii) is from about 85° C. to about 95° C.

22. A process in accordance with claim 1 wherein the time of coalescence or fusion is from about 12 to about 20 hours, and wherein there are provided toner particles with a smooth morphology.

23. A process in accordance with claim 1 wherein the latex contains a resin or polymer selected from the group consisting of poly(styrene-propyl acrylate 3-metacryloxy-2-hydroxypropyltrimethyl ammonium chloride), poly(styrene-butyl acrylate 3-metacryloxy-2-hydroxypropyltrimethyl ammonium chloride), poly(styrene-alkyl acrylate 3-metacryloxy-2-hydroxypropyltrimethyl ammonium chloride), poly(styrene-1,3-diene 3-metacryloxy-2-hydroxypropyltrimethyl ammonium chloride), poly(styrene-alkyl methacrylate 3-metacryloxy-2-hydroxypropyltrimethyl ammonium chloride), poly(styrene-alkyl acrylate-3-metacryloxy-2-hydroxypropyltrimethyl ammonium chloride, poly(styrene-1,3-diene-3-metacryloxy-2-hydroxypropyltrimethyl ammonium chloride, poly(styrene-alkyl methacrylate-3-metacryloxy-2-hydroxypropyltrimethyl ammonium chloride, poly(alkyl methacrylate-alkyl acrylate-3-metacryloxy-2-hydroxypropyltrimethyl ammonium chloride, poly(alkyl methacrylate-aryl acrylate-3-metacryloxy-2-hydroxypropyltrimethyl ammonium chloride, poly(aryl methacrylate-alkyl acrylate 3-metacryloxy-2-hydroxypropyltrimethyl ammonium chloride, poly(alkyl methacrylate-acrylic acid 3-metacryloxy-2-hydroxypropyltrimethyl ammonium chloride, poly(styrene-alkyl acrylate-acrylonitrile-3-metacryloxy-2-hydroxypropyltrimethyl ammonium chloride, poly(styrene-1,3-diene-acrylonitrile-3-metacryloxy-2-hydroxypropyltrimethyl ammonium chloride, and poly (alkyl acrylate-acrylonitrile-3-metacryloxy-2-hydroxypropyltrimethyl ammonium chloride.

24. A process in accordance with claim 1 wherein the latex contains a resin selected from the group consisting of poly(styrene-butadiene 3-metacryloxy-2-hydroxypropyltrimethyl ammonium chloride), poly (methylstyrene-butadiene 3-metacryloxy-2-hydroxypropyltrimethyl ammonium chloride), poly(methyl methacrylate-butadiene 3-metacryloxy-2-hydroxypropyltrimethyl ammonium chloride), poly(ethyl methacrylate-butadiene 3-metacryloxy-2-hydroxypropyltrimethyl ammonium chloride), poly(propyl methacrylate-butadiene 3-metacryloxy-2-hydroxypropyltrimethyl ammonium chloride), poly(butyl methacrylate-butadiene 3-metacryloxy-2-hydroxypropyltrimethyl ammonium chloride), poly(methyl acrylate-butadiene 3-metacryloxy-2-hydroxypropyltrimethyl ammonium chloride), poly(ethyl acrylate-butadiene 3-metacryloxy-2-hydroxypropyltrimethyl ammonium chloride), poly(propyl acrylate-butadiene 3-metacryloxy-2-hydroxypropyltrimethyl ammonium chloride), poly(butyl acrylate-butadiene 3-metacryloxy-2-hydroxypropyltrimethyl ammonium chloride), poly(styrene-isoprene 3-metacryloxy-2-hydroxypropyltrimethyl ammonium chloride), poly(methylstyrene-isoprene 3-metacryloxy-2-hydroxypropyltrimethyl ammonium chloride), poly(methyl methacrylate-isoprene 3-metacryloxy-2-hydroxypropyltrimethyl ammonium chloride), poly(ethyl methacrylate-isoprene 3-metacryloxy-2-hydroxypropyltrimethyl ammonium chloride), poly (propyl methacrylate-isoprene 3-metacryloxy-2-hydroxypropyltrimethyl ammonium chloride), poly(butyl methacrylate-isoprene 3-metacryloxy-2-hydroxypropyltrimethyl ammonium chloride), poly(methyl acrylate-isoprene 3-metacryloxy-2-hydroxypropyltrimethyl ammonium chloride), poly(ethyl acrylate-isoprene 3-metacryloxy-2-hydroxypropyltrimethyl ammonium chloride), poly(propyl acrylate-isoprene 3 metacryloxy-2-hydroxypropyltrimethyl ammonium chloride), poly(butyl acrylate-isoprene 3-metacryloxy-2-hydroxypropyltrimethyl ammonium chloride); poly(styrene-propyl acrylate 3-metacryloxy-2-hydroxypropyltrimethyl ammonium chloride), poly(styrene-butyl acrylate 3-metacryloxy-2-hydroxypropyltrimethyl ammonium chloride), poly(styrene-butadiene 3-metacryloxy-2-hydroxypropyltrimethyl ammonium chloride), poly(styrene-butadiene 3-metacryloxy-2-hydroxypropyltrimethyl ammonium chloride), poly(styrene-butadiene-acrylonitrile 3-metacryloxy-2-hydroxypropyltrimethyl ammonium chloride), poly(styrene-butyl acrylate 3-metacryloxy-2-hydroxypropyltrimethyl ammonium chloride), and poly(styrene-butyl acrylate-acrylononitrile 3-metacryloxy-2-hydroxypropyltrimethyl ammonium chloride).

25. A process in accordance with claim 1 wherein said magnetite functions as a negatively charged coagulant and is present in an amount of about 22 to about 35 weight percent and is dispersed in a cationic surfactant in an amount of about 0.1 to about 5 weight percent; said carbon black is present in an amount of about 3 to about 8 percent by weight dispersed in water containing a cationic surfactant in an amount of about 0.1 to about 5 weight percent; said wax is present in the amount of about 4 to about 12 weight percent dispersed in water containing a cationic surfactant in the amount of about 0.1 to about 5 weight percent; and the cationic latex is present in an amount of about 40 to about 65 percent by weight.

26. A process in accordance with claim 1 wherein heating is accomplished while mixing.

27. A process in accordance with claim 1 wherein said magnetite dispersion is comprised of about 25 to about 35 percent magnetite, about 65 to about 70 percent water, and about 0.5 to about 2 percent cationic surfactant; carbon black dispersion comprised of said 4.5 percent carbon black, and about 2 percent cationic surfactant with the remainder being water, and wherein the latex emulsion comprises about 34 percent solids of styrene, 78.8 percent, butylacrylate, 17.3 percent, and 3-metacryloxy-2-hydroxypropyltrimethyl ammonium chloride, 3.8 percent, and wherein said wax dispersion is comprised of about 30 percent wax, 2 percent cationic surfactant and the remaining percentage being water, wherein the latex contains a resin of poly(styrene-propyl acrylate 3-metacryloxy-2-hydroxypropyltrimethyl ammonium chloride), poly(styrene-butyl acrylate 3-metacryloxy-2-hydroxypropyltrimethyl ammonium chloride), poly(styrene-butadiene 3-metacryloxy-2-hydroxypropyltrimethyl ammonium chloride), poly (styrene-butadiene 3-metacryloxy-2-hydroxypropyltrimethyl ammonium chloride), poly(styrene-butadiene-acrylonitrile 3-metacryloxy-2-hydroxypropyltrimethyl ammonium chloride), or poly (styrene-butyl acrylate-acrylononitrile 3-metacryloxy-2-hydroxypropyltrimethyl ammonium chloride) wherein the cationic surfactant is selected from the group consisting of a dialkyl benzenealkyl ammonium chloride, lauryl trimethyl ammonium chloride, alkyl benzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, and wherein the wax selected is a polypropylene, a polyethylene or a carnuba wax.

28. A process in accordance with claim 1 wherein said heating is below about the latex resin glass transition temperature, followed by a heating above about the latex resin glass transition temperature.

29. An imaging method or printing process wherein the toner of claim 1 is selected.

* * * * *